US005922985A

United States Patent [19]

Taniwaki

[11] Patent Number: 5,922,985

[45] Date of Patent: Jul. 13, 1999

[54] WOODWIND-STYLED ELECTRONIC MUSICAL INSTRUMENT

[75] Inventor: Tomu Taniwaki, Hamamatsu, Japan

[73] Assignee: Yamaha Corporation, Hamamatsu, Japan

[21] Appl. No.: 09/123,703

[22] Filed: Jul. 28, 1998

[30] Foreign Application Priority Data

Jul. 29, 1997 [JP] Japan ..... 9-217028

[51] Int. Cl.[6] ..... G10H 1/34; G10H 3/12

[52] U.S. Cl. ..... 84/742; 84/743

[58] Field of Search ..... 84/615–620, 644, 84/653–658, 670, 678–690, 718–721, 742–746, DIG. 7

[56] References Cited

U.S. PATENT DOCUMENTS

| | | | |
|---|---|---|---|
| 3,938,419 | 2/1976 | De Rosa | 84/678 |
| 4,203,338 | 5/1980 | Vidas | 84/678 |
| 4,919,032 | 4/1990 | Sakashita | 84/653 |
| 5,668,340 | 9/1997 | Hashizume et al. | 84/742 |

*Primary Examiner*—Stanley J. Witkowski
*Attorney, Agent, or Firm*—Graham & James LLP

[57] ABSTRACT

A woodwind-styled electronic musical instrument comprises a plurality of manipulating note keys for designating note names in an octave of the tones to be produced, a plurality of manipulating octave keys for designating octave levels of the tones to be produced, and a mouth manipulating device for controlling the generation of each of the tones to be produced having a note name and an octave level as designated by the manipulating note keys and the manipulating octave keys. The manipulating note keys are arranged on the front surface of the instrument body. The manipulating octave keys are arranged on the back surface of the instrument body around the thumb rest of the instrument in two separate groups, the one group being for shifting up the octave level of the tones to be produced and the other group being for shifting down the octave level of the tones to be produced, wherein the octave level is determined in accordance with the combination of the manipulated octave keys in each of the groups. The octave keys can be selectively manipulated by a rolling motion ol the left thumb without a sliding motion thereof. The mouth manipulating device is arrange at the top end of the instrument body.

5 Claims, 11 Drawing Sheets

Fig.6

| |
|---|
| BKCD : BASIC KEY CODE DATA INDICATIVE OF NOTE KEY POSITION |
| OCT : OCTAVE SHIFT DATA |
| KCD : KEY CODE DATA |
| BRE1: PRESENT WIND DATA |
| BRE2 : PRECEDING WIND DATA |
| ⋮ |

CONTENTS OF REGISTER

Fig.7

| D2 | D1 | U1 | U2 | M (mode) | OUTPUT |
|---|---|---|---|---|---|
| 1 | 0 | 0 | 0 | 0 | -3 |
| 1 | 0 | 0 | 0 | 1 | -2 |
| 1 | 1 | 0 | 0 | 0 | -2 |
| 1 | 1 | 0 | 0 | 1 | -2 |
| 0 | 1 | 0 | 0 | 0 | -1 |
| 0 | 1 | 0 | 0 | 1 | -1 |
| 0 | 0 | 0 | 0 | 0 | 0 |
| 0 | 0 | 0 | 0 | 1 | 0 |
| 0 | 0 | 1 | 0 | 0 | +1 |
| 0 | 0 | 1 | 0 | 1 | +1 |
| 0 | 0 | 1 | 1 | 0 | +2 |
| 0 | 0 | 1 | 1 | 1 | +2 |
| 0 | 0 | 0 | 1 | 1 | +2 |
| 0 | 0 | 0 | 1 | 0 | +3 |

OCTAVE KEY TABLE

WOODWIND-STYLED ELECTRONIC MUSICAL INSTRUMENT

BACKGROUND OF THE INVENTION

1. Field of the Invention

The present invention relates to an electronic musical instrument having the style of a woodwind musical instrument and being played in the manner similar to that of playing a woodwind musical instrument.

2. Description of the Prior Art

Among electronic musical instruments, the most popular ones are keyboard type electronic musical instruments, and recently developed and put into practical use are woodwind-styled electronic musical instruments which exhibit shapes similar to acoustic woodwind musical instruments and are played in a similar manner. An example of such conventional woodwind-styled electronic musical instruments is shown schematically in FIGS. 13(*a*) and 13(*b*), in which FIG. 13(*a*) is a front view of the instrument from its front side and FIG. 13(*b*) is a rear view of the instrument from its back side.

The woodwind-styled electronic musical instrument as shown comprises an instrument body 111, a mouthpiece 112 and a plurality of key switches 113 arranged on the front side of the instrument body 111 for designating notes for playing music. These key switches 113 are divided into two groups 113*a* and 113*b* in which the group 113*a* is for manipulation by the left hand fingers and located nearer to the mouthpiece 112 and the group 113*b* is for manipulation by the right hand fingers and is located farther from the mouthpiece 112, both groups of key switches being consecutively arranged along the front surface of the instrument body 111 of a longitudinal rod shape. Among the key switches 113, the home position key switches are provided with circular pad elements for a quick identification thereof, while the other key switches are provided with somewhat elongated cylindrical front surfaces for the reach of the fingers.

Further on the back surface of the instrument body 111, there are provided a plurality of octave key switches 114 arranged in a row along the longitudinal direction thereof. Among these octave key switches 114, those numbered 114-1, 114-2 and 114-3 are octave key switches for shifting up the octave level of the tones to be produced, while those numbered 114-4 and 114-5 are octave key switches for shifting down the octave level of the tones to be produced. Thus, the concurrent manipulation of the note designating key switches 113 and the octave key switch 114 determines the note name and the octave level of the tone to be produced, the fingering pattern of the note designating key switches determining the note name within an octave and the selection of the octave key switch determining the octave level for that note name. For example, when none of the octave key switches 114 are manipulated, the note name determined by the note key switches will be given a basic (middle) octave level, and a tone of that note name are produced in the middle octave range. When the octave key switch 114-1 is manipulated, the note name is given a octave level which is one octave higher than the basic octave level, i.e. the octave of the produced tone is shifted up by one (+1). Likewise, when the octave key switch 114-2 is manipulated, the octave of the produced tone is shifted up by two (+2). Further, when the octave key switch 114-3 is manipulated, the octave of the produced tone is shifted up by three (+3). On the other hand, when the octave key switch 114-4 is manipulated, the octave of the produced tone is shifted down by one (−1). Still further, when the octave key switch 114-5 is manipulated, the octave of the produced tone is shifted down by two (−2).

In this way, the combined manipulation of any one of the octave witches 114 which designates an octave range and of the plurality of note key switches 113 which designate a note name within an octave will permit designation of any notes within the available span of the musical scale by the instrument to realize a musical performance using musical tones over a plurality of octaves. The octave key switches 114 are positioned in the upper area on the back surface of the instrument body 111 to be manipulated by the left thumb.

The timing for the tone production is controlled by the player's breath pressure applied at the mouthpiece 112. The mouthpiece, therefore, includes therein a wind sensor (pressure sensor) which detects the pressure of the player's breath. The instrument is usually further provided with a program change switch for selecting a tone color to be used, a mechanism for setting the standard octave for the instrument, etc., With the woodwind-styled electronic musical instrument as explained above referring to FIGS. 13(*a*) and 13(*b*), a player performs a musical tune by manipulating the octave key switches 114 and the note designating key switches 113 in accordance with the musical notation on a score. The manipulation of the keys for a musical performance is such that the fingers (except thumbs) of the both hands actuate the note key switches 113*a* provided on the front surface of the instrument body while the left thumb actuates the octave key switches 114 provided on the back surface of the instrument. The octave key switches 114, however, are provided in spaced-apart locations along the longitudinal axis on the back surface of the instrument body 111 so that the player has to slide the left thumb in the longitudinal direction (upward and downward in the performing posture) for selecting the intended octave key switch 114. The sliding movement of the left thumb tends to cause a like movement of other fingers of the left hand as well, which would deviate the positions of the finger tips thereby jeopardizing the precise actuation of the note designating keys for the performance.

For example, if the designation of six octaves be available, five more octaves have to be arbitrarily selected in addition to a basic octave, and consequently there should be provided five octave key switches as shown in FIG. 13 (*b*). If the instrument should cover further expanded octaves, more octave key switches 114 would further be necessary and further shifting of the left thumb position would be required.

SUMMARY OF THE INVENTION

It is, therefore, a primary object of the present invention to provide an electronic musical instrument of a woodwind style which requires no substantial sliding movement of the left thumb for actuating the octave designating keys to designate any desired octaves.

Another object of the present invention is to provide an electronic musical instrument of a woodwind style which has a fewer number of octave designating keys but is capable of producing many octaves of tones.

In order to accomplish the above mentioned and other objects, an electronic musical instrument of a woodwind style in one aspect of the present invention comprises a plurality of manipulating note keys for designating note names of the tones to be produced, a plurality of manipulating octave keys for designating octave levels of the tones to be produced, and a mouth manipulating device for controlling the generation of each of the tones to be produced having a note pitch and an octave level as designated by the manipulating note keys and the manipulating octave keys. The manipulating note keys are arranged on the front surface of the instrument body. The manipulating octave keys are arranged on the back surface of the instrument body around the thumb rest of the instrument. The octave keys can be selectively manipulated by the player's thumb without parting from the thumb rest. The mouth manipulating device is arranged at the top end of the instrument body.

According to another aspect of the present invention, an electronic musical instrument of a woodwind style comprises manipulating octave keys which are positioned along the circumference of said thumb rest portion in such a configuration that the octave keys are selectively manipulated by a rolling motion of tile thumb without a sliding motion thereof. The player of the instrument can manipulate the octave keys without affecting the fingering of note keys.

According to another aspect of the present invention, an electronic musical instrument of a woodwind style comprises manipulating octave keys which are arranged in two separate groups, the one group including a plurality of octave keys for shifting up the octave level of the tones to be produced and the other group including another plurality of octave keys for shifting down the octave level of the tones to be produced, wherein the octave level is determined in accordance with the combination of the manipulated octave keys in each of the two groups. The player can quickly designate a shift up or a shift down of the octave.

According to another aspect of the present invention, an electronic musical instrument of a woodwind style comprises a mode selection device arranged on the instrument body for designating a first mode and a second mode such that an octave level determined by the combination of the manipulated keys in each of said groups under the selection of the first mode is different from an octave level determined by the combination of the manipulated keys in each of said groups under the selection of the second mode. The player can use musical tones in a wide range of octaves according to the player's choice.

BRIEF DESCRIPTION OF THE DRAWINGS

For a better understanding of the present invention, and to show how the same may be practiced and will work, reference will now be made, by way of example, to the accompanying drawings, in which:

FIG. 6 is a data structure chart of an example of the register configuration provided in the RAM shown in FIG. 5;

FIG. 7 is an octave key table showing the relation between combinations of the octave key switches with the mode switch and the amounts of octave shift;

DESCRIPTION OF THE PREFERRED EMBODIMENTS

Figure 1A:
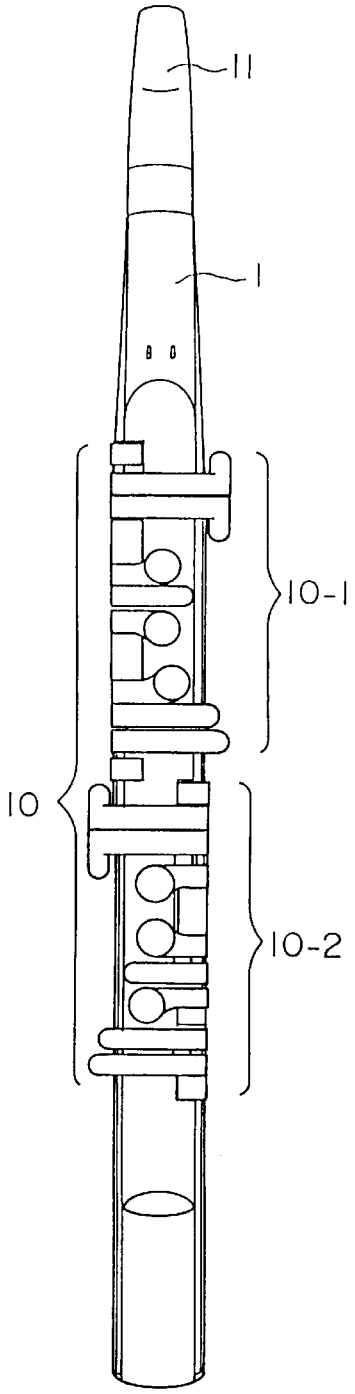
FIGS. 1(*a*), 1(*b*) and 1(*c*) are a front view, a side view and a bottom view showing a configuration of an embodiment of an electronic musical instrument of a woodwind style according to this invention.
Figure 1B:
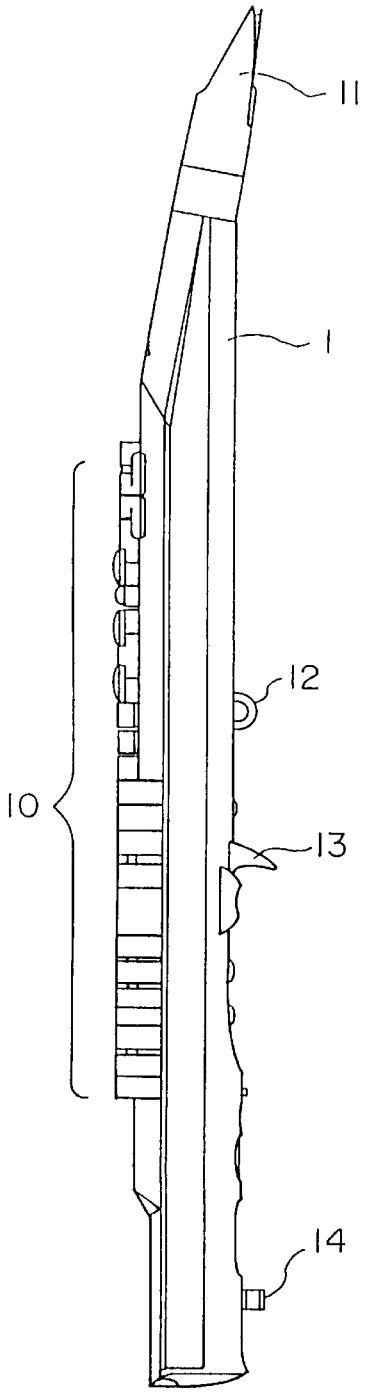
Figure 1C:
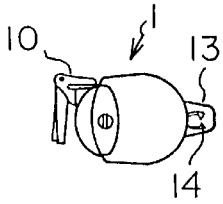

Illustrated in FIGS. 1(*a*), l(*b*) and 1(*c*) of the drawings are a front view, a side view and a bottom view showing a configuration of an embodiment of an electronic musical instrument of a woodwind style according to this invention. As shown in these Figures, an electronic musical instrument of a woodwind style according to this invention comprises an instrument body 1 of a longitudinal rod shape and a mouthpiece 11, and on the front surface of the instrument body 1 there are provided a plurality of manipulating note designating key switches 10 for designating note pitches of tones to be produced. These key switches are divided into two groups 10-1 and 10-2 for the manipulation by the left hand fingers and by the right hand fingers, respectively, wherein the group 10-1 is located nearer to the mouthpiece 11 and the group 10-2 is located farther from the mouthpiece 11 for convenience of manipulation by the both hand fingers in performance. These two groups 10-1 and 10-2 of note designating key switches are arranged consecutively along the front surface of the instrument body 1. Further, the home position key switches among these note designating key switches 10 are provided with circular disk shaped pad elements for a quick identification thereof, and the other key switches are provided with somewhat elongated cylindrical front surfaces for receiving the reach of the fingers.

On the back surface of the instrument body 1, there provided a strap ring 12 for coupling a hook of a neck strap to support the instrument and a thumb rest 13 to which is to abut a right thumb of an instrument player to hold the instrument body stably. Although not apparent in FIGS. 1(*a*), 1(*b*) and 1(*c*), there are also arranged octave designating key switches in the area on the back surface of the instrument body 1 where the left thumb of the instrument player will reach during performance. Further on the back surface of the instrument body 1, there is provided a cable clamp 14 which pinches and holds an electric communication cable (not shown here) for transmitting the MIDI signals and so forth outputted from the back side of the instrument body 1.

Figure 2A:
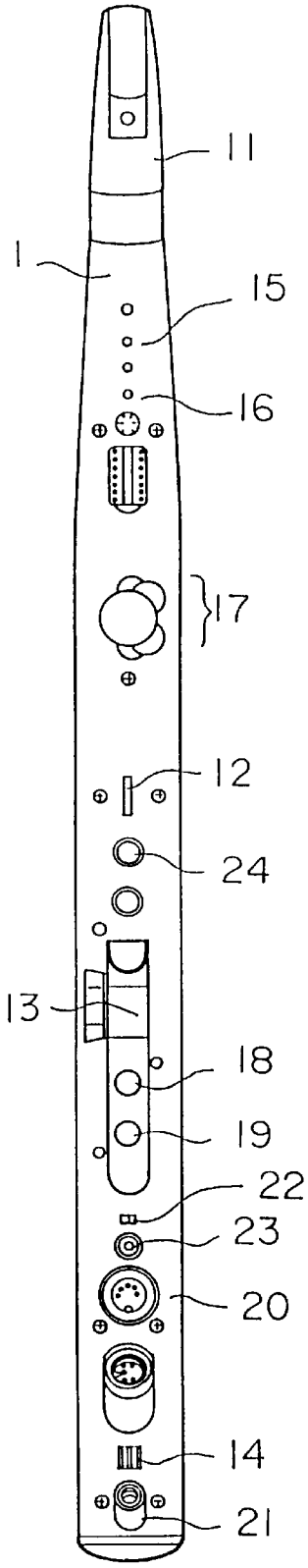
FIGS. 2(*a*) and 2(*b*) are a rear view showing a configuration of an embodiment of an electronic musical instrument of a woodwind style according to this invention and an enlarged partial rear view of the same around the octave designating keys.
Figure 2B:
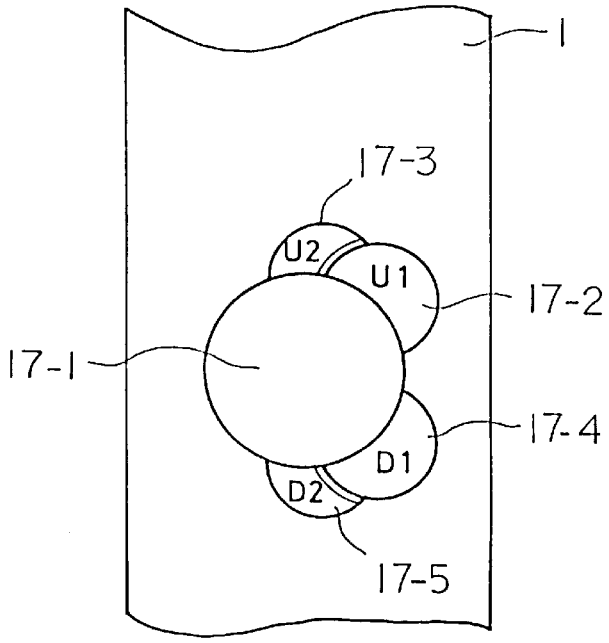

The details of an example of the back side configuration is shown in FIGS. 2(*a*) and 2(*b*). As depicted there, mouthpiece 11 is integrally provided at the top end portion of the instrument body 1. In the vicinity of the top end portion, there are provided a wind gain volume 15 which adjust the gain of a wind sensor included in the mouthpiece 11 for detecting the wind pressure of the breath of the player blown into the mouthpiece 11, its zero point adjusting control, a lip gain volume 16 which adjust the gain of a lip sensor included in the mouthpiece 11 for detecting the biting strength of the player applied onto the mouthpiece 11 and its zero point adjusting control. Further on the back surface of the instrument body 1, there are provided a plurality of octave designating key switches 17 arranged in the area where the player's left thumb is to locate during performance.

FIG. 2(*b*) is an enlarged view around the octave designating key switches 17 in FIG. 2(*a*) and shows a first example of the arrangement of the octave designating key switches. In the configuration of the example shown in this Figure, a thumb rest 17-1 of a substantially circular shape is formed in the center of this area for regular abutment of the player's left thumb during performance. Along the circumference of the thumb rest 17-1 are formed two octave designating key switches 17-2 and 17-3 adjacent to each other for octave up-shifting on the upper side of the thumb rest 17-1, and also two octave designating key switches 17-4 and 17-5 adjacent to each other for octave down-shifting on the lower side of the thumb rest 17-1 as opposed to the up-shifting key switches 17-2 and 17-3.

The four octave designating key switches 17-2 through 17-5 are shaped and positioned differently from each other as shown in FIG. 2(*b*). That is to say, blind touch on each octave designating key will readily identify which one among them from the shape and the location. As the width of thumb of an adult is about 15 mm to 30 mm at most, the sizes and the layout of the octave designating key switches 17-2 through 17-5 are determined taking such a thumb width into consideration.

As mentioned before, a strap ring 12 and a thumb rest 13 are provided on the back surface of the instrument body 1, and between the strap ring 12 and the thumb rest 13 is provided a mode switch 24 for selecting either of a first mode and a second mode of the octave shifting. The modes are for determining the relation between the combinations of the actuated octave designating key switches 17-2 through 17-5 and the resultant octave shift amounts.

Further on the back surface of the instrument body 1, there are provided a key hold switch 18 for holding (i.e. to keep on sounding) the sounding tone during manipulation of the keys, and a program change switch 19 for changing over the timbre (tone color) of the tone generator. Still further on the back surface of the instrument body 1, there are provided a power switch 22 for turning on/off the electric power, a power jack 23 for supplying electric power therethrough, MIDI output terminal 20 for outputting the generated MIDI signal, and a water drain 21 for passing out water or breath therethrough.

Figure 3B:
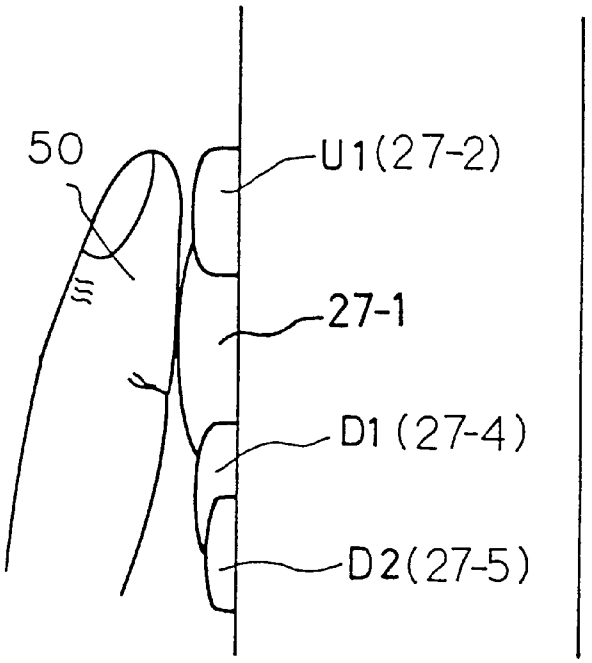
FIGS. 3(*a*) and 3(*b*) are an enlarged partial rear view and an enlarged partial side view showing a configuration of another embodiment of the octave designating keys according to this invention.
Figure 3A:
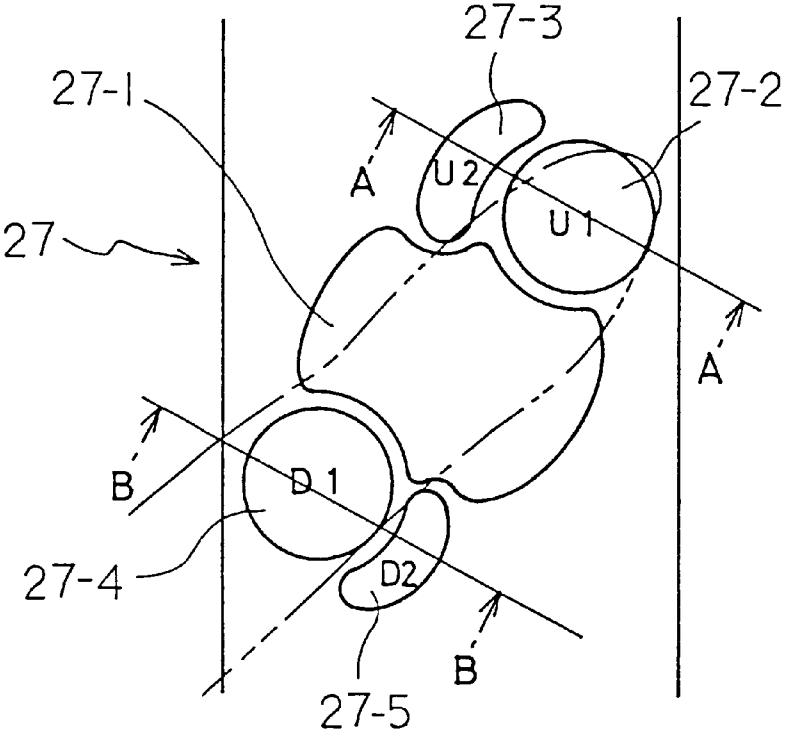
Figure 4A:
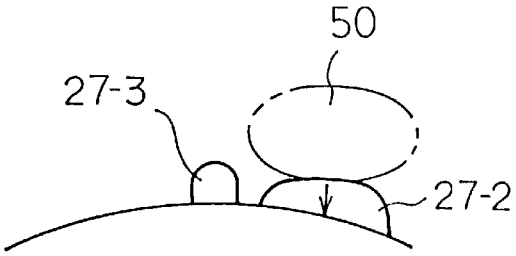
FIGS. 4(*a*), 4(*b*) and 4(*c*) are cross sectional views taken and viewed at the view line A—A of FIG. 3(*a*), and FIGS. 4(*d*), 4(*e*) and 4(*f*) are cross sectional views taken and viewed at the view line B—B of FIG. 3(*a*)
Figure 4D:
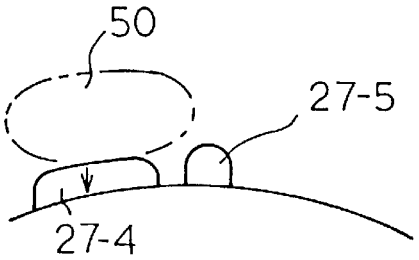
Figure 4B:
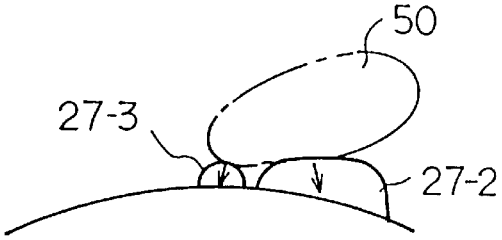
Figure 4E:
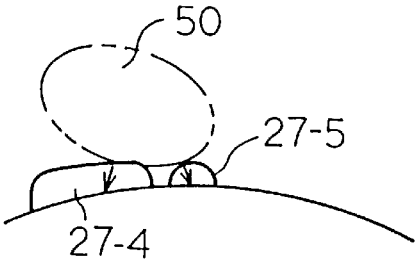
Figure 4C:
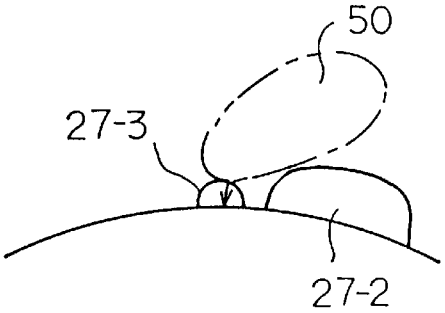
Figure 4F:
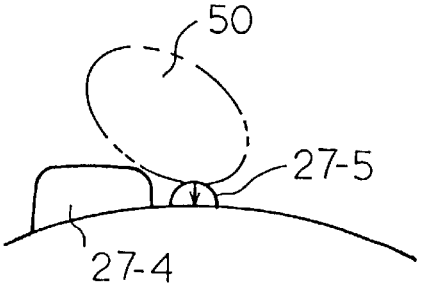

Now turn to FIGS. 3(*a*) and 3(*b*) which show a second embodiment of the octave designating key switch configuration. As shown in these Figures, a thumb rest 17-1 is formed in the center area for the player's thumb to abut. Adjacent to the thumb rest 27-1 on the obliquely right upper side thereof are an octave designating key switch 27-2 of a substantially circular shape and another octave designating key switch 27-3 of a substantially arcuate shape adjacent to each other both for up-shifting the octaves. Adjacent to the thumb rest 27-1 on the obliquely left lower side thereof ire an octave designating key switch 27-4 of a substantially circular shape and another octave designating key switch 27-5 of a substantially arcuate shape adjacent to each other both for down-shifting the octaves. The peripheral contour of the thumb rest 27-1 is shaped to match the neighboring contours of the four octave designating key switches as seen in FIG. 3(*a*). Further, the thumb rest 27-1 has a height which is greater than the heights of the octave designating key switches 27-2 through 27-5 from the level of the back surface of the instrument body as seen from FIG. 3(*b*). The four octavel designating key switches 27-2 through 27-5 are shaped and located differently as shown in FIGS. 3(*a*) and 3(*b*). With such a configuration, the player can readily identify each of the octave designating key switches by simply touching the front surfaces thereof with the thumb.

The above described first and second embodiments are similar in the actuation manner of the octave designating key switches, and therefore the manner of manipulation will hereinafter be described on the second embodiment with reference to FIGS. 4(*a*) through 4(*f*), in which FIGS. 4(*a*) through 4(*c*) are cross sectional views as seen along the line A—A in FIG. 3(*a*) whereas FIGS. 4(*d*) through 4(*f*) are cross sectional views as seen along the line B—B in FIG. 3(*a*).

First the player put the palm side of the left thumb 50 onto the thumb rest 27-1 as its home position. This situation is illustrated in FIG. 3(*a*) with a two-dot chain line and in FIG. 3(*b*) with a solid line as a side view. As the height of the thumb rest 27-1 is the greatest in this vicinity, the thumb 50 which is resting on the thumb rest 27-1 at this home position posture does not press any octave designating key switches 27-2 through 27-5 inadvertently. Under this condition, the player has to simply bend down the tip portion of the thumb 50 onto the key switch button 27-2 without replacing the thumb as shown in FIG. 4(*a*) to actuate the octave designating key switch 27-2. In order to actuate both of the octave designating key switches 27-2 and 27-3 simultaneously, the player has only to rotate (roll) the palm side surface of the thumb 50 and press both of the key switches 27-2 and 27-3 obliquely by the tip portion of the thumb as shown in FIG. 4(*b*). If the octave designating key switch 27-3 should be actuated alone, the thumb 50 should be rotated further obliquely to press only the key switch button 27-3 with the tip portion of the thumb as shown in FIG. 4(*c*).

Further under the condition that the thumb is located at the home position, the actuation of only the octave designating key switch 27-4 can be performed by pressing the key switch button 27-4 with the first joint area of the palm side surface of the thumb 50 without replacing the thumb as shown in FIG. 4(*d*). In order to actuate both of the octave designating key switches 27-4 and 27-5 simultaneously, the player has only to rotate the palm side surface of the thumb 50 in the direction opposite to the above explained direction and press both of the key switches 27-4 and 27-5 obliquely by the joint area of the palm side surface of the thumb 50 as shown in FIG. 4(*e*). If the octave designating key switch 27-5 should be actuated alone, the thumb 50 should be rotated further obliquely to press only the key switch button 27-5 with the joint area of the palm side surface of the thumb as shown in FIG. 4(*e*).

As will be understood from the above description, the instrument provides six kinds of key actuation pattern by simply changing the postures of the left thumb which stays at approximately the same location. Thus, the instrument covers seven octaves for performance, including one basic (standard) octave, three higher octaves and three lower octaves. In case the mode switch 24 is set at another condition for preventing inadvertent erroneous actuations, the instrument will cover five octaves as will be described herein below.

Referring to an octave table of FIG. 7, the amounts of octave shifts determined by the actuation of the octave designating key switches 17 (or 27) together with the mode switch 24 will be as follows. In FIG. 7, U1 represents the octave designating key switches 17-2 and 27-2, U2 represents the key switches 17-3 and 27-3, D1 represents the key switches 17-4 and 27-4 and D2 represents the key switches 17-5 and 27-5. M represents the mode switch 24. And the numeral "1" means that the switch is actuated (depressed) while the numeral "0" means that the switch is not actuated. The output values represent the amounts of octave shift, wherein the symbol "+" means an up-shifting and the symbol "−" means a down-shifting.

In this instance, when none of the octave designating key switches D2, D1, U1 and U2 are actuated, the output value is "0" irrespective of the actuation of the mode switch M, and therefore the octave shift amount will be "0". This means that the tones will be generated in the basic (middle) octave range. When only the octave designating key switch D1 is actuated, the output value is "−1" irrespective of the actuation of the mode switch M, and therefore the tones will be generated in the one-octave down-shifted lower octave. Further, when the octave designating key switches D1 and D2 are both actuated simultaneously, the output value is "−2" irrespective of the actuation of the mode switch M, and therefore the tones will be generated in the two-octave down-shifted lower octave. Still further, when only the octave designating key switch D2 is actuated, the output value will be different depending on whether the mode switch is actuated or not, i.e. the amount of downward octave shift will vary accordingly. More specifically, when the mode switch M is actuated, the output value will be "−2" to shift down the octave range of the generated tones by two octaves, and when the mode switch M is not actuated, the output value will be "−3" to shift down the octave range of the generated tones by three octaves.

On the other hand, when only the octave designating key switch U1 is actuated, the output value is "+1" irrespective of the actuation of the mode switch M. and therefore the tones will be generated in the one-octave up-shifted higher octave. When the octave designating key switches U1 and U2 are both actuated simultaneously, the output value is "+2" irrespective of the actuation of the mode switch M, and therefore the tones will be generated in the two-octave up-shifted higher octave. When only the octave designating key switch U2 is actuated, the output value will be different depending on whether the mode switch is actuated or not, i.e. the amount of upward octave shift will vary accordingly. More specifically, when the mode witch M is actuated, the output value will be "+2" to shift up the octave range of the generated tones by two octaves, and when the mode switch M is not actuated, the output value will be "+3" to shift up the octave range of the generated tones by three octaves. In this way, the mode switch M provides two different manners of octave shift amount designation responsive to the actuation of the octave designating key switches, and therefore the player can select the more preferable mode for the performance beforehand depending on the musical tune to play.

Figure 5:
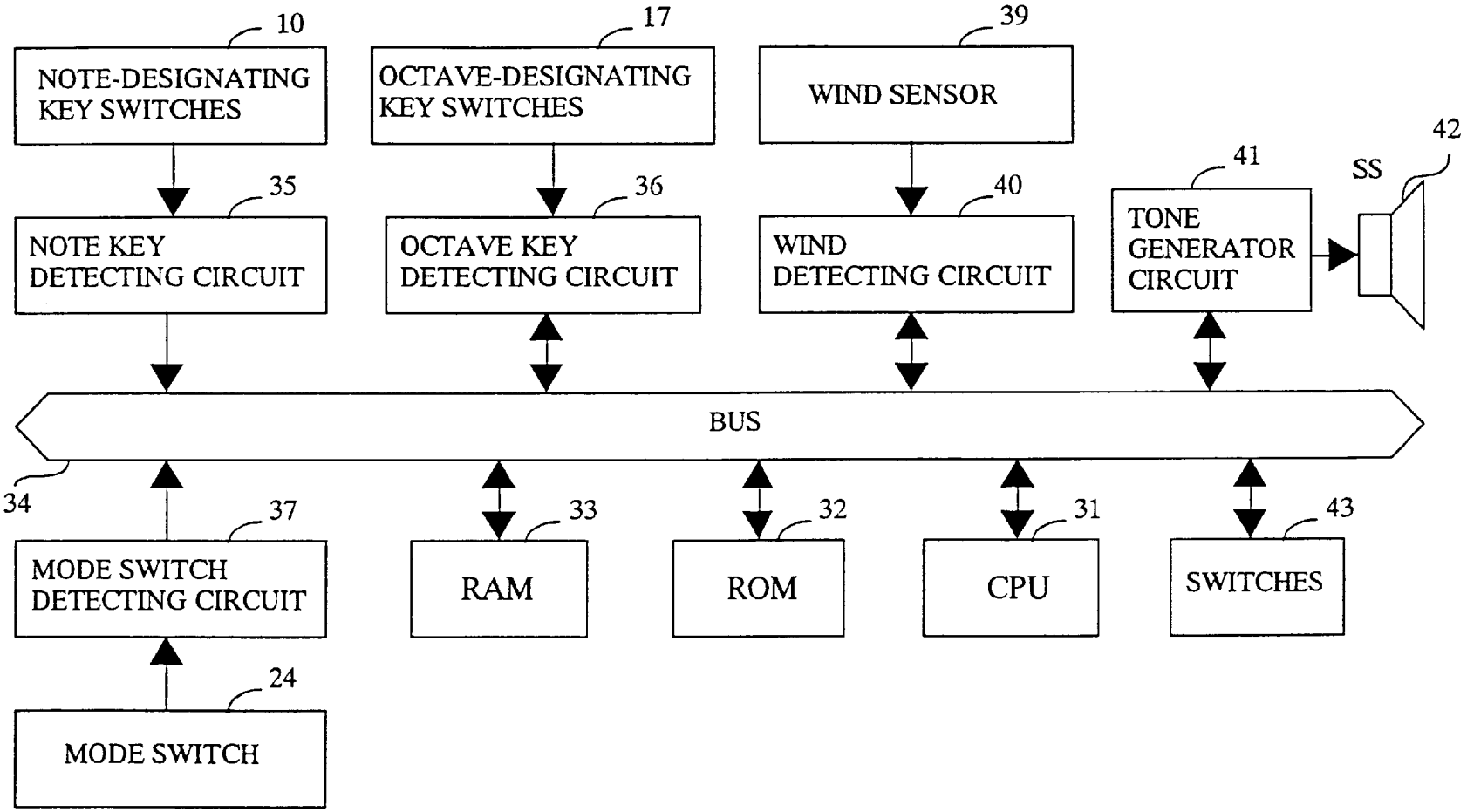
FIG. 5 is a block diagram showing a hardware structure of an embodiment of an electronic musical instrument according to this invention.

Next, an embodiment of the electric hardware construction of an electronic musical instrument of this invention provided with the octave designating key switches D2, D1, U1 and U2 and the mode designating switch 24 as shown in FIGS. 1(*a*), 1(*b*), 1(*c*), 2(*a*) and 2(*b*) will be described with reference to the block diagram. of FIG. 5. In FIG. 5, the electronic hardware of the invention comprises a central processing unit (CPU) 31 performing logic operations, a read only memory (ROM) 32 storing control programs for the general control of the woodwind-styled electronic musical instrument, tone generation process programs and some associated programs, and a random access memory (RAM) 33 on which various register areas and work areas are provided to be used in the data processing. All of these elements 31, 32 and 33 are connected with a common bus 34.

The CPU 31 executes the tone generation process programs stored in the ROM 32 and conducts data acquisition necessary for tone generation by detecting the respective switch conditions, the sensor conditions, etc. Various parameters which are set prior to the musical performance, various data representing the actuations of the instrument for the musical performance, various temporary data to be processed during execution of the programs and so forth are stored in the register areas and the work areas which are provided in the RAM 33. When the note designating key switches 10 arranged on the instrument body 1 are actuated, a note key detecting circuit 35 detects which ones of the note designating key switches 10 are actuated. Likewise, the actuations of the octave designating key switches 17 (27) are detected by an octave key detecting circuit 36. The actuation of the mode switch 24 is detected by a mode switch detecting circuit 37.

The breath pressure applied into the mouthpiece 11 is sensed by a wind sensor 39 provided in the mouthpiece 11, and is detected by a wind detecting circuit 40. The CPU 31 accesses the note key detecting circuit 35, the octave key-detecting circuit 36, the mode switch detecting circuit 37 and the wind detecting circuit 40 to receive the detection result data, and transmits those detection result data to a tone generator circuit 41 as a plurality of parameters for determining each musical tone to be generated. Upon receipt of these parameter signals, the tone generator circuit 41 forms or synthesizes each tone signal based on the parameter values. The method to be employed for the tone formation or synthesis may be of any type including conventional ones such as a wave memory read-out type, an FM synthesis type and a harmonics synthesis type. The tone generator circuit 41 includes a DAC (digital-to-analog converter) circuit, which finally converts the synthesized digital tone signals to analog tone signals, which in turn are emitted as audible musical sounds through a sound system (SS) 42 provided externally. In this instance, both the tone generator circuit 41 and the sound system 42 may be provided externally so that the MIDI signals outputted from the MIDI output terminal 20 shown in FIG. 2(*a*) can be supplied to the tone generator circuit 41 to emit musical sounds from the sound system 42.

Other switches 43 includes the key hold switch 18, the program change switch 19 and other switches for setting properties of the tones to be generated such as a tone color and modes of the performance intended, and are connected to the bus 34.

For playing the instrument of this embodiment, the player manipulates to push down the intended one or ones of the note designating key switches 10 according to the fingering patterns to determine the note name in an octave, and pushes down none or any of the octave designating key switches 17 (27) to designate the octave level for the intended note. When the octave designating key U1 or U2 or both are depressed, an octave shift signal indicating up-shifting of the octave will be produced to shift up the octave level of the note to be generated by an amount designated according to the actuated octave key or keys. When the octave designating key D1 or D2 or both are depressed, an octave shift signal indicating down-shifting of the octave will be produced to shift down the octave level of the note to be generated by an amount designated according to the actuated octave key or keys. In this way, the note pitch (note name and octave level) of the tone to be generated is designated. The timing for the tone production is governed by the timing of applying the breath pressure on the wind sensor 39. When the breath pressure vanishes, the generated tone ceases.

Next, the configuration of the registers provided in the RAM 33 is described hereinbelow with reference to FIG. 6. As outlined in the Figure, a register BKCD, a register OCT, a register KCD, a register BRE1, a register BRE2, etc. are provided in the RAM 33. The register BKCD is a register which stores the basic key code data obtained by the note key position, i.e. the actuation pattern of the note designating key switches 10. The register OCT is a register which stores the octave shift data representing the actuation state (on/off) of the octave designating key switches 17. The register KCD is a register which stores the key code data representing the note pitch of the musical tone to be generated. The register BRE1 is a register which stores the present wind data (breath data) as detected by the wind sensor 39, and the register BRE2 is a register which stores the preceding wind data as detected by the wind sensor prior to the present sensing. The exemplary use of these registers will be described hereunder referring to the flowcharts depicted in the Figures.

Figure 8:
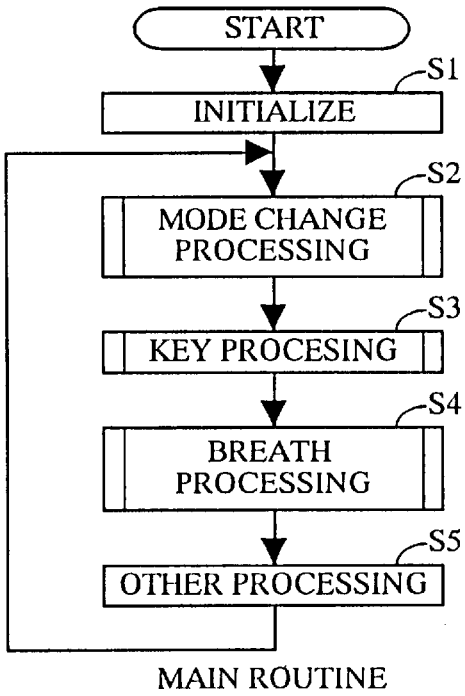
FIG. 8 is a flowchart showing the main routine of the processing executed in an embodiment of an electronic musical instrument according to this invention.

FIG. 8 shows a flowchart of the main routine of the processing performed by the CPU 31 executing the tone generation process program. As depicted in FIG. 8, upon start of the main routine, a step S1 initializes the associated registers and so forth. Next, a step S2 performs a mode change processing. In this mode change processing, the state of the mode switch 24 is detected, and then the processing determined by the detected state is conducted. Then a step S3 performs a key processing with respect to the note designating key switches 10 and the octave designating key switches 17 (27). In this key processing, the actuated key switches are detected, and the processing determined by the detected result is conducted.

After the key processing, a step S4 performs a breath processing, in which the start/stop process of tone generation is conducted based on the detected output from the wind sensor 39. A step S5 conducts other processing, which includes switching over the timbres (tone colors) of the tones to be generated. And the processing flow returns to step S2 to repeat steps S2 through S5. The repetition of this routine, of step S2 through step S5 realizes the generation of the tones for music performance in accordance with the manipulations of the key switches and other switches on the electronic musical instrument of a woodwind style of the present invention.

Figure 9:
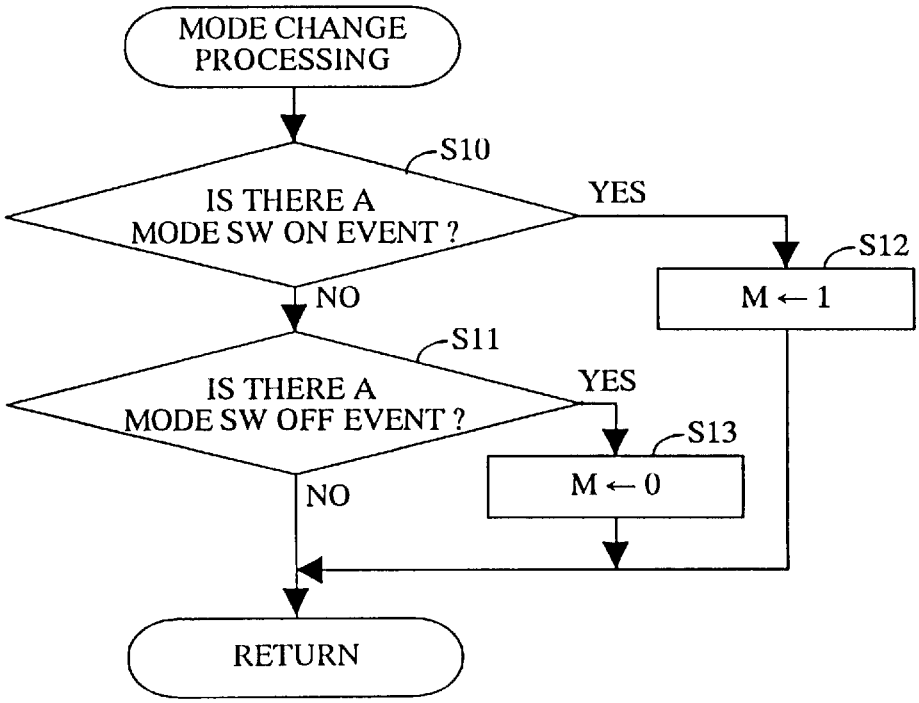
FIG. 9 is a flowchart showing the subroutine of the mode change processing in the main routine shown in FIG. 8.

Next, an explanation is made about the mode change processing at step S2 in the main routine with reference to a subroutine flowchart shown in FIG. 9. Upon initiation of the mode change processing, a step S10 judges whether the mode switch 24 is turned on. When the mode switch 24 is pushed on, i.e. a mode switch on-event happens, the step S10 judges "YES" and the process moves to a step S12 to set a mode flag M to be "1", and then the process returns to the main routine. When the mode switch 24 is not actuated, the step S10 judges "NO" and the process moves forward to a step S11 to judge whether the mode switch 24 is turned off, i.e. a mode switch off-vent happens. If the mode switch 24 is pushed off, the step S11 judges "YES" and the process goes forward to a step S13 to set a mode flag M to be "0", and then the process returns to the main routine. If the mode switch 24 is not actuated, the step S11 judges "NO" and then the process returns to the main routine without a flag change.

Figure 10:
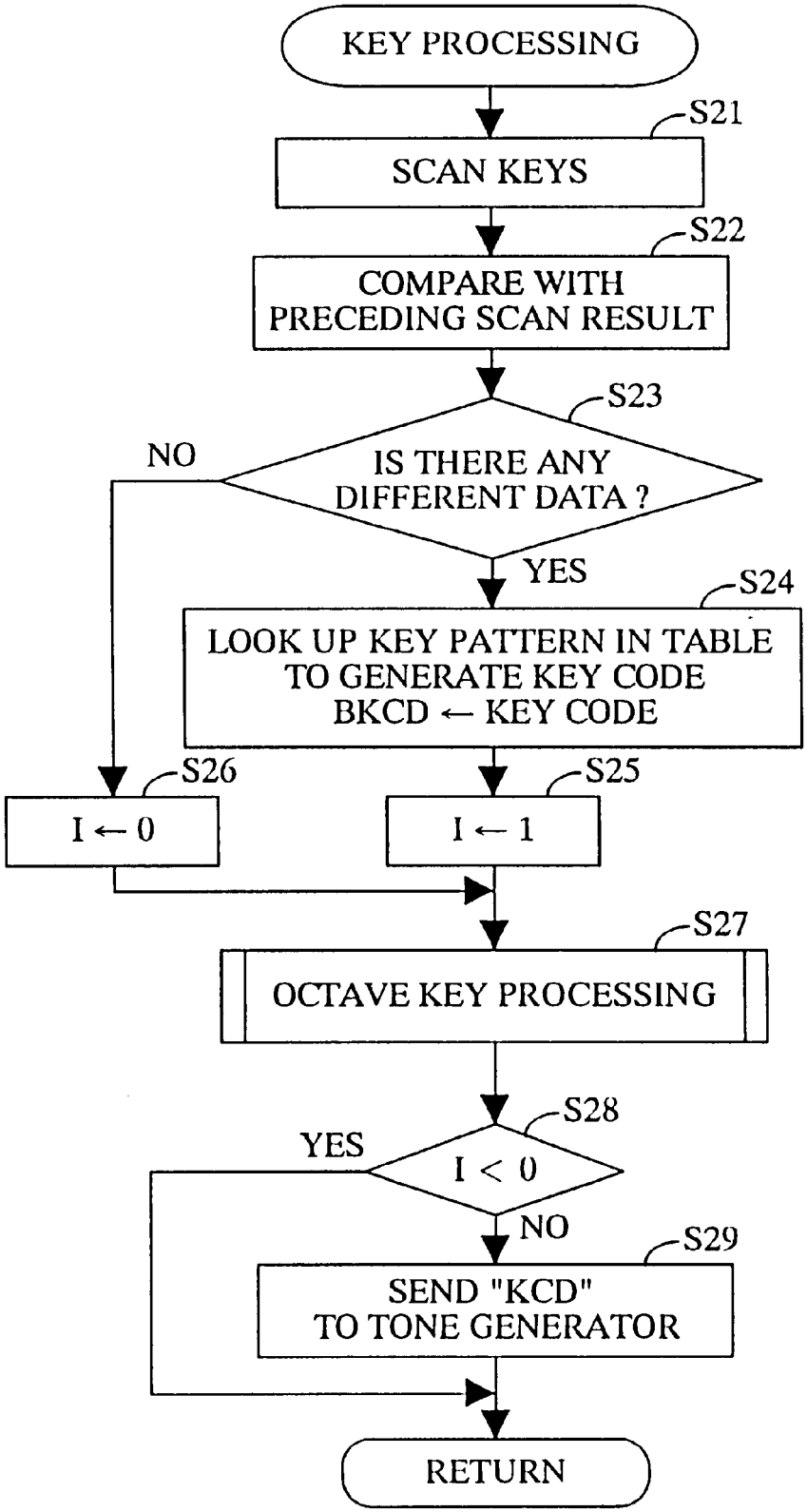
FIG. 10 is a flowchart showing the subroutine of the key processing in the main routine shown in FIG. 8.

Next, an explanation is made about the key processing at step S3 is the main routine with reference to a subroutine flowchart shown in FIG. 10. Upon initiation of the key processing, first a step 21 conducts key scanning to detect which of the note designating key switches 10 is/are depressed. The next step S22 compares the present detection result of the key scanning with the preceding detection result of the preceding key scanning. A step S23 is to judge whether there is any data difference between the two consecutive key scanning results. If there is different data by any new manipulations of the note designating key switches 10, the answer of the judgment is "YES" and the process moves to a step S24, which looks up the key pattern of the new manipulation state of the note designating key switches 10 in a key code table (not shown) to generate a key code corresponding to the manipulated key switches 10. The generated key code is stored in the register BKCD shown in FIG. 6.

Next, in a step S25, a value "1" is set into a register I as a preparation for an octave key processing performed in a step S27 as described later. In case there is no newly manipulated note designating key switches 10 and the judgment at the step S23 is "NO", the process goes forward to a step S26, which sets a value "0" into the register I as a preparation for the octave key processing performed in the step S27. The octave key processing is to shift the octave levels (ranges) of a note to be generated by shifting a data value of the key code stored in the register BKCD by an amount determined by a manipulation state of the octave designating key switches 17 (27).

After the octave key processing at the step S27, a step S28 judges whether the data in the register I is less than "0" or not. If the content of the register I is not less than "0", the judgment result is "NO" and the process moves to a step S29, which sends the data content in the register KCD to the tone generator circuit 41. Thereafter, the process returns to the main routine processing. If the content of the register I is less than "0", the judgment result is "YES" and the processing flow skips the step S29 and directly returns to the main routine.

Figure 11:
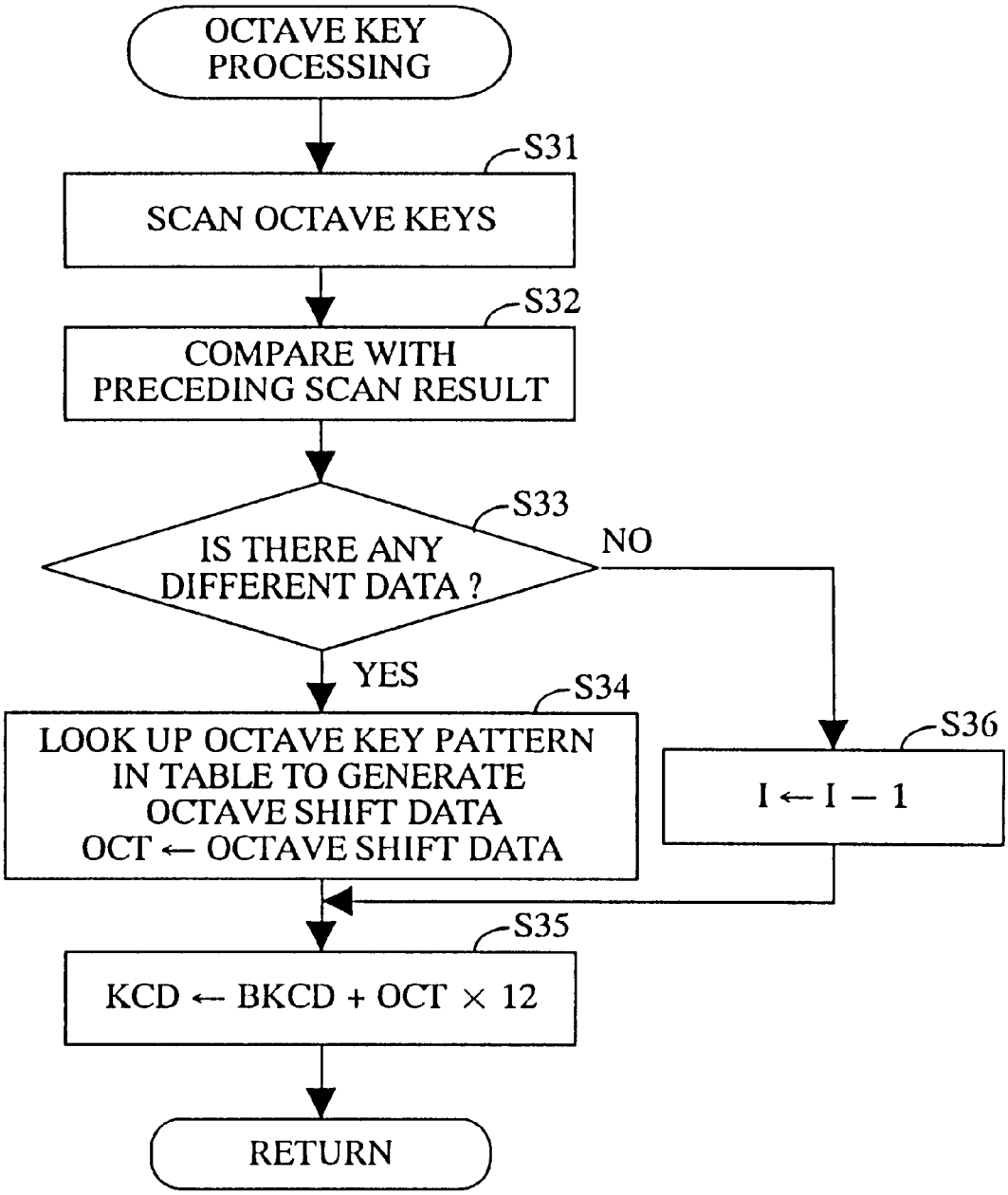
FIG. 11 is a flowchart showing the subroutine of the octave key processing in the main routine shown in FIG. 8.

Now, an explanation is made about the octave key processing at the step S27 in the key processing of FIG. 10 with reference to a subroutine flowchart shown in FIG. 11. Upon initiation of the octave key processing, a step S31 scans the octave designating key switches 17 (27) to detect the manipulation state of the octave designating key switches 17 (27). Then, a step S32 compares the octave key(s) detected by the current key scanning with the octave key(s) detected by the preceding key scanning. A step S33 is to judge whether there is any data difference between the two consecutive scanning results.

In this instance, if any new octave designating key switches 17 (27) are manipulated, the step S32 detects a data difference and then the step S3.3 judges "YES" to move the process to a step S34. The step S34 is to look up the octave key pattern of the currently manipulated state of the octave designating key switches 17 (27) in the octave key table shown in FIG. 7 to generate octave shift data corresponding to the current octave key manipulation. The generated octave shift data is stored in the register OCT shown in FIG. 6. Then, the value of the register OCT is multiplied by "12" (twelve) to convert into the number of semitones to express the note location by a value in a chromatic scale, and is added to the basic key code stored in the register BKCD which was obtained in response to the manipulations of the note designating key switches 10, consequently to obtain a key code representing the absolute note pitch for the tone to be produced. The key code is stored in the register KCD shown in FIG. 6, and then the process flow returns to the key processing routine of FIG. 10.

In case there is no newly manipulated octave designating key switches 17 (27) and consequently no data difference in the octave key scanning, the step S33 judges "NO" to divert the process flow to a step S36 to subtract "1" from the value in the register I before moving forward to the step S35 for the above-described key code calculation.

In case the judgment by the step S23 in FIG. 10 is "NO" where the present key scanning and the preceding key scanning of the note designating key switches reveal the same result, process moves to a step S26 to set "0" into the register I. And further if the judgment by the step S33 in FIG. 11 is "NO" meaning that the present key scanning and the preceding key scanning of the octave designating key switches reveal the same result, the process moves forward to the step S36 to subtract "1" from the value in the register I. Therefore, in the step S28 in FIG. 10, the judgment with respect to the content of the register I is "YES" (i.e. a minus value), which skips the step S29. Other than these above-described situations, the judgment by the step S28 is always "NO".

To summarize, where there is no change in the manipulation states of the note designating key switches 10 and the octave designating key switches 17 (27), the process of sending the content of the register KCD to the tone generator 41 is not performed. And where there is a change in the manipulation states of the note designating key switches 10 and the octave designating key switches 17 (27), the steps S23 and/or S33 judge a data difference in the note key data and/or the octave key data, and consequently the content of the register KCD is sent to the tone generator 41.

So far is an explanation about the note pitch designation based on the manipulations during the instrument play for a music performance. The start/stop of the generation of musical tones is to be conducted by the breath processing as described hereinbelow.

Figure 12:
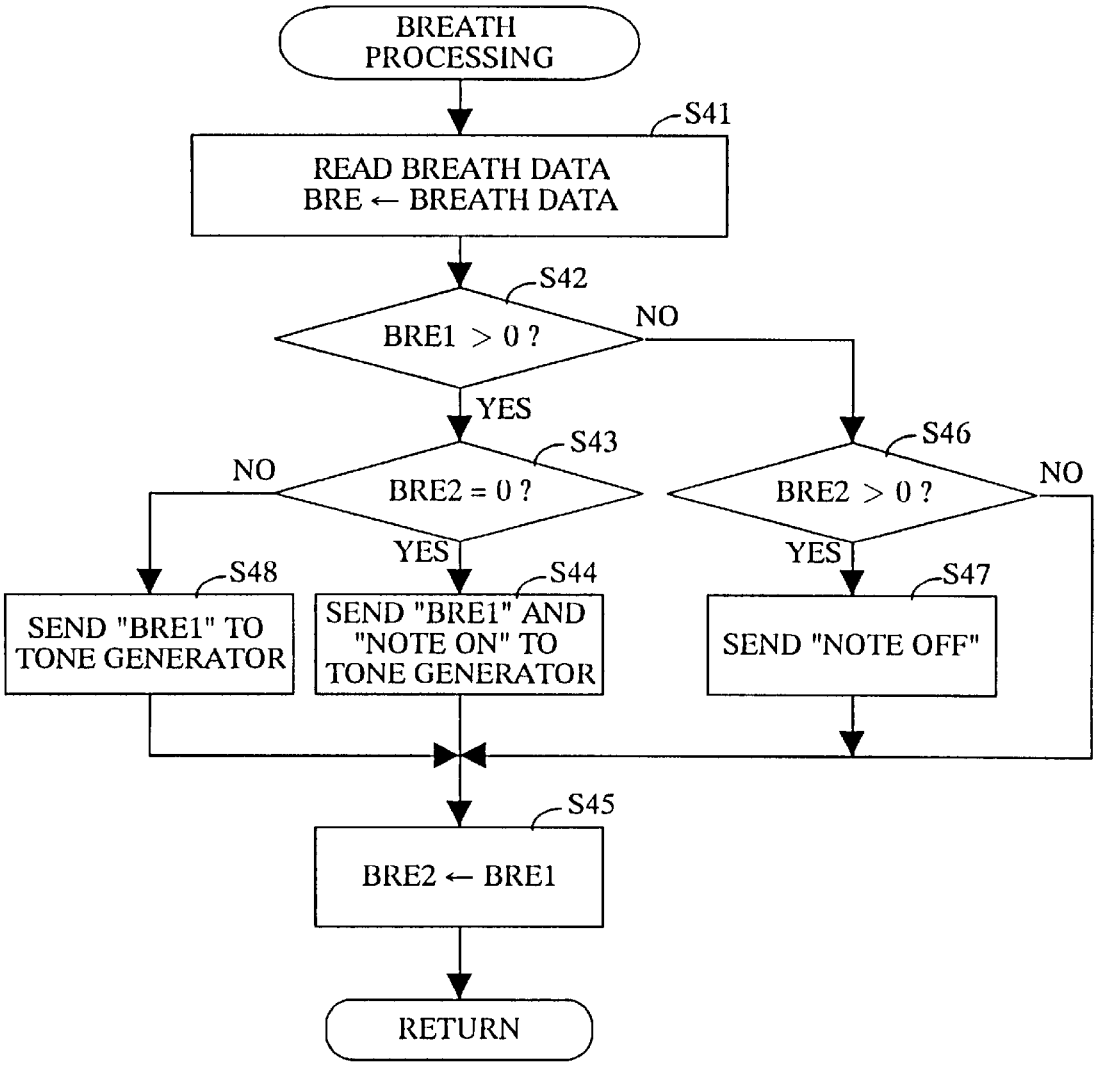
FIG. 12 is a flowchart showing the subroutine of the breath processing in the main routine shown in FIG. 8.
Figure 13A:
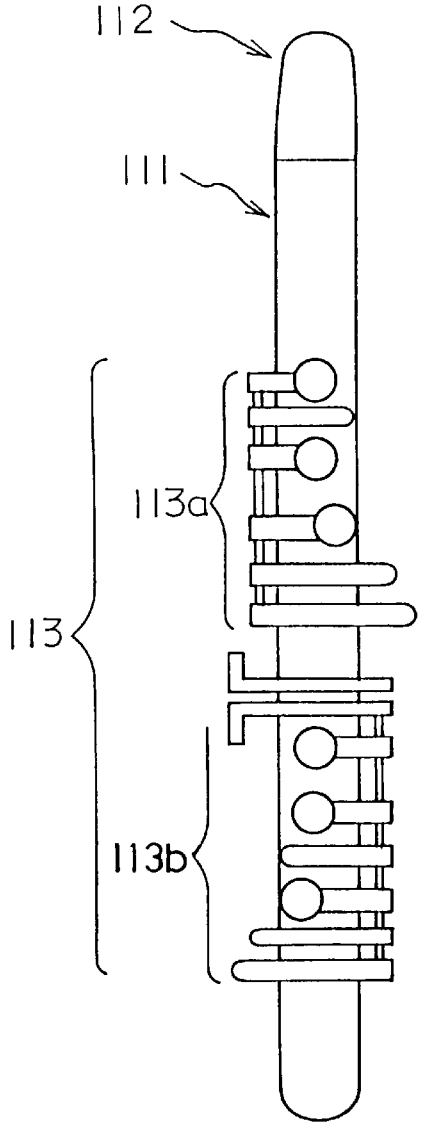
FIGS. 13(*a*) and 13(*b*) are a front view and a rear view showing a configuration of an example of a conventional electronic musical instrument of a woodwind style.
Figure 13B:
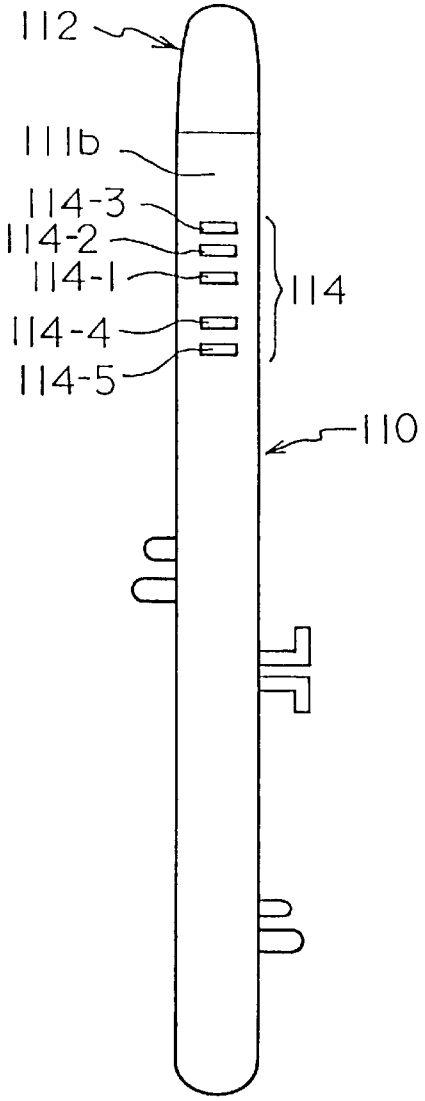

Now an explanation will be made about the breath processing with reference to a subroutine flowchart shown in FIG. 12 which depicts a processing flow of the step S4 for the breath processing in the main routine of FIG. 8. Upon initiation of the breath processing, a step S41 reads the breath data detected by the wind sensor 39 and inputs the same into the register BRE1 shown in FIG. 6. Next, a step S42 judges whether the breath data stored in the register BRE1 is greater than "0" (i.e. Positive) or not. If the breath data in the register BRE1 is positive meaning that there is a breath pressure applied by the player, the step S42 judges "YES" to move the process to a step S43 to judge whether the breath data stored in the register BRE2 which represents the breath pressure of the preceding read is "0" or not. If, in this instance, the preceding breath data in the register BRE2 is "0", which means that this is a new application of a breath pressure after the absence of a breath pressure, then the step S43 judges "YES" to move the process to a step S44 to send the breath pressure data BRE1 and a note-on signal to the tone generator 41. Thereafter, the process goes forward to a step S45 to renew the breath data by substituting the breath data in the register BRE1 into the register BRE2.

On the other hand, if the preceding breath data in the register BRE2 representing the breath pressure at the preceding detection is not "0", which means that the breath pressure is being applied continuously, there is already a note-on signal generated before. Therefore, when the step S43 judges "NO", the process moves to a step S48 to send only the present breath pressure data BRE1 to the tone generator circuit 41. Thereafter, the process moves forward to the step S45 to renew the breath data as described above.

In case the step S42 judges that the breath pressure is not positive (i.e. "NO"), the processing moves to a step S46 to judge whether the preceding breath pressure BRE2 is positive or not. And if the preceding breath pressure is not positive (i.e. "NO"), either, there is no musical tone being generated, and the process moves to the step S45 to renew the breath pressure data as described above. But if the preceding breath pressure is positive (i.e. "YES"), this means that the breath pressure by tile player has just disappeared now. Therefore, when the judgment by the step S46 is "YES", the process moves to a step S47 to send a note-off signal to the tone generator circuit 41, thereby stopping the generation of the musical tone.

In the manner described above, generation (including starts and stores) of the musical tones are conducted in the electronic musical instrument of a woodwind style according to the present invention based on and responsive to the manipulations of the note designating key switches 10 and the octave designating key switches 17 (27) according to the instrument play for a musical performance.

As described above, an electronic musical instrument of a woodwind style according to the present invention is provided with manipulating octave, keys which are arranged in a plurality of groups and are configured along the circumference of the thumb rest against which a thumb of an instrument player is to abut when supporting the instrument body. Therefore, the octave designating keys can be easily manipulated by merely rolling the thumb which abuts the thumb rest in the back surface of the instrument body without sliding the position of the thumb. This prevents the manipulation of the note designating keys from being disturbed by the manipulation of the octave designating keys. Further, as the octave shifts are designated by the combinations of the octave keys, a fewer octave keys can designate a wider octave range. Furthermore, if the shape of each octave key is configured differently from each other, the player can recognize which is which by blind touching, which serves to eliminate erroneous actuations of the octave keys.

It should be understood, that the above described flowcharts for the, tone generation control are merely for exemplary purposes, and that any other flowcharts may be employed for the same purposes without departing from the spirit of the present invention. While particular embodiments of the invention have been described, it should be understood, of course, that the invention is not limited thereto, since modifications, improvements and combinations may be made by those skilled in the art, particularly in light of the foregoing teachings. It is therefore contemplated by the appended claims to cover any such modifications that incorporate those features of these improvements in the true spirit and scope of the invention.

What is claimed is:

1. An electronic musical instrument comprising:

an instrument body of a longitudinal rod shape having a front surface and a back surface;

a plurality of manipulating note keys arranged on said front surface for designating note names of tones to be produced;

a plurality of manipulating octave keys arranged on said back surface for designating octave levels of said tones to be produced; and a mouth manipulating device arranged at the top end of said instrument body for controlling the generation of each of said tones to be produced having a note name and an octave level as designated by said manipulating note keys and said manipulating octave keys;

said octave keys including a plurality of manipulating keys arranged in a plurality of groups around a thumb rest portion on said back surface of the instrument body, said thumb rest portion being a portion against which a thumb of an instrument player is to abut when supporting the instrument body;

the octave of each of said tones to be produced being determined by a combination of the manipulated ones of said octave keys.

2. An electronic musical instrument as claimed in claim 1, wherein in said manipulating octave keys are positioned along the circumference of said thumb rest portion such that the octave keys are selectively manipulated by a rolling motion of the thumb without a sliding motion thereof.

3. An electronic musical instrument as claimed in claim 1, wherein in said manipulating octave keys are arranged in two separate groups, the one group including a plurality of octave keys for shifting up the octave level of the tones to he produced and the other group including another plurality of octave keys for shifting down the octave level of the tones to be produced, the octave level being determined in accordance with a combination of the manipulated octave keys in each of said groups.

4. An electronic musical instrument as claimed in claim 3, further comprising a mode selection device arranged on said instrument body for designating a first mode and a second mode such that an octave level determined by the combination of the manipulated keys in each of said groups under the selection of said first mode is different from an octave level determined by the combination of the manipulated octave keys in each of said groups under the selection of said second mode.

5. An electronic musical instrument as claimed in claim 1, wherein said thumb rest has a height which is greater than the heights of said octave designating key switches from the level of said back surface of the instrument body.

* * * * *